US006497544B1

(12) United States Patent
Schmücker et al.

(10) Patent No.: US 6,497,544 B1
(45) Date of Patent: Dec. 24, 2002

(54) MACHINE FOR CASING INNER BOOKS INTO BOOK CASES

(75) Inventors: Christoph Schmücker, Rahden (DE); Reimer Voss, Belm (DE)

(73) Assignee: Kolbus GmbH & Co. KG, Rahden (DE)

( * ) Notice: Subject to any disclaimer, the term of this patent is extended or adjusted under 35 U.S.C. 154(b) by 132 days.

(21) Appl. No.: 09/707,402

(22) Filed: Nov. 7, 2000

(30) Foreign Application Priority Data

Nov. 20, 1999 (DE) ..... 199 55 993

(51) Int. Cl.[7] ..... B42C 7/00

(52) U.S. Cl. ..... 412/17; 412/9; 412/19; 412/21

(58) Field of Search ..... 412/1, 3, 5, 9, 412/17, 19, 21, 37

(56) References Cited

U.S. PATENT DOCUMENTS

| | | | | |
|---|---|---|---|---|
| 3,201,810 A | * | 8/1965 | Thorp | |
| 4,565,477 A | * | 1/1986 | Axelrod | 281/21.1 |
| 4,710,256 A | * | 12/1987 | Ladewig et al. | 156/216 |
| 4,978,267 A | * | 12/1990 | Kolkhorst | 412/19 |
| 5,868,539 A | * | 2/1999 | Rathert | 281/21.1 |
| 5,980,182 A | * | 11/1999 | Yen | 412/17 |

FOREIGN PATENT DOCUMENTS

| | | |
|---|---|---|
| DE | OS 1536 505 | 2/1970 |
| DE | OS 195 40 213 A1 | 4/1997 |
| DE | 196 39 575 A1 | 4/1998 |

* cited by examiner

*Primary Examiner*—A. L. Wellington
*Assistant Examiner*—Monica Carter
(74) *Attorney, Agent, or Firm*—Alix, Yale & Ristas, LLP

(57) ABSTRACT

A machine for casing inner books into book cases by gluing the outer end papers of an inner book to the inner surfaces of the covers of a book case, having a conveyor, which at cyclical intervals feeds successive inner books with the spine directed upwards in a vertical plane of motion to a cyclically fed book case, which is held in position in the plane of motion of the inner book, and having means for moving the covers up against the inner book and joining the end papers and book covers, is, in view of a compact design which is less expensive to manufacture, characterised by a feeding conveyor (5), which feeds the inner book (2) with the spine directed upwards to a lower receiving point and has a device (15–17) for spreading apart the outer end papers (2*a*) of the inner book (2), and by a gripper (21), which grasps the inner book (2) between the spread-apart outer end papers (2*a*) and conveys it from the lower receiving point to an upper joining point.

20 Claims, 2 Drawing Sheets

A
B
C

MACHINE FOR CASING INNER BOOKS INTO BOOK CASES

BACKGROUND OF THE INVENTION

The invention relates to an apparatus for casing inner books into book cases by gluing the outer end papers of an inner book to the inner surfaces of the covers of a book case. The apparatus includes a conveyor, which at cyclical intervals feeds successive inner books with the spine directed upwards in a vertical plane of motion to a cyclically fed book cases, which are held in position in the plane of motion of each of the inner book, and includes means for moving the covers up against the inner book and joining the end papers and book covers.

From DE-OS 1 536 505, for example, an insetting machine is known, comprising a revolving conveyor having chains, which lie in parallel vertical planes and are guided around deflection chain wheels. That apparatus also includes a plurality of horizontally aligned saddle plates spaced uniformly apart from one another and coupled to the chains. For assembling respective inner books and book cases, in a so-called casing process, the inner books are fed by a conveyor with their front cut resting on a web and in the process are pushed onto a divider element before being taken over astride the saddle plates as a result of the saddle plates travelling through the divider element.

For casing the inner books with correct registration with the book case, reciprocally operating contact pressure elements movable upwards in synchronism with the conveyor are provided, which are applied onto the book spine and/or onto the spine of the book case and movable in closed, loop-shaped paths of motion from a starting position lying against the book, upwards as well as down along a path separate from the path of motion of the book and back into the starting position.

The books, carried astride the saddle plates and moving down along the vertical path of motion, are delivered in a book delivery apparatus, in which the books are supported against a stop rail having a through-slot for the saddle plates and are deposited onto a conveyor by a reciprocating transfer plate.

The vertically oriented saddle plate conveyor used in the known insetting machines and also known as a paternoster is of a heavy, bulky design owing to the plurality of saddle plates on parallel chain systems with their deflection chain wheels. Insetting machines and saddle plate conveyors, viewed as a whole, entail a high design and manufacturing outlay. When the inner books are pushed onto the divider element there is a risk of individual signatures or sheets being upset, which leads to malfunctions. Furthermore, the still fresh, particularly bulky inner books may be torn when they are taken over by the saddle plates moving upwards at a high clock frequency. In the case of thin inner books, it is impossible to rule out smearing of the saddle plates or deforming of the inner book spines. Finally, inner books having specially designed printed sheets, which pop up upon opening, do not permit a central take-over by saddle plates.

The object of the invention is to provide a machine of the type described for casing inner books into book cases by gluing the outer end papers of an inner book to the inner surfaces of the covers of a book case, which machine in comparison to the described prior art is to be of a compact design. Furthermore, the machine is to entail a lower constructional outlay, be less expensive to manufacture while maintaining the same quality of manufacture of the books and enable shortening of the set-up time.

SUMMARY OF THE INVENTION

This object is achieved by the invention in a simple and economical manner by means of a feeding conveyor, which feeds the inner book with the spine directed upwards to a lower receiving point and has a device for spreading apart the outer end papers of the inner book, and by means of a gripper, which grasps the inner book between the spread-apart outer end papers and conveys it from the lower receiving point to an upper joining point.

It is obvious that an inner book gripper which is displaceable along a relatively short, rectilinear, vertical path of motion between two end positions as a means of conveying the inner books, instead of a saddle plate conveyor operating on the paternoster principle and having devices for centrally dividing the inner books for take-over by the saddle plates, entails a far lower constructional outlay. Starting from the constant groove edge of the inner books, the inner book gripper travels always with a constant stroke from the lower receiving point into the upper joining point, which guarantees a taut casing of the inner books into the book case. By virtue of the centred positioning of the inner book in the gripper combined with the centreo-riented transport of the book case, the book is always precisely aligned with the book case. The automatic adjustment to book and/or inner book thickness by means of pneumatic clamping helps to shorten the set-up time. The insetting machine may be used to case in all relevant products, and indeed even products which do not allow central dividing.

In DE-OS 195 40 213 having the same assignee as the present application an insetting machine without use of a known fixed tray conveyor with saddle plates is described. In this machine, inner books with their spine directed upwards are taken over by a transport device by means of adhesive application rollers which, by rolling along the inner book, apply an adhesive film onto the surface of the end papers and feed the inner book to an awaiting book case. On the way up, the inner book is grasped in the groove region by tips of lifting pincers, transported further in a vertical plane and assembled in the spine with a book case held in position. Book case and inner book then move on into the effective range of contact pressure rollers having recesses for the book to pass through. The book is held clamped by the stationary contact pressure rollers and lifted by a vertical motion of the contact pressure rollers, wherein the book covers for the return stroke of the lifting pincers are supported against rods without material contact. By virtue of a rotational motion of the contact pressure rollers effected simultaneously with the return stroke, the contact pressure rollers transport the book into a top end position and rub the end papers against the book covers.

BRIEF DESCRIPTION OF THE DRAWING

There now follows a detailed description of the embodiment of the invention which is diagrammatically illustrated in the drawings, which show.

DESCRIPTION OF THE PREFERRED EMBODIMENT

Figures 1, 2, 4:
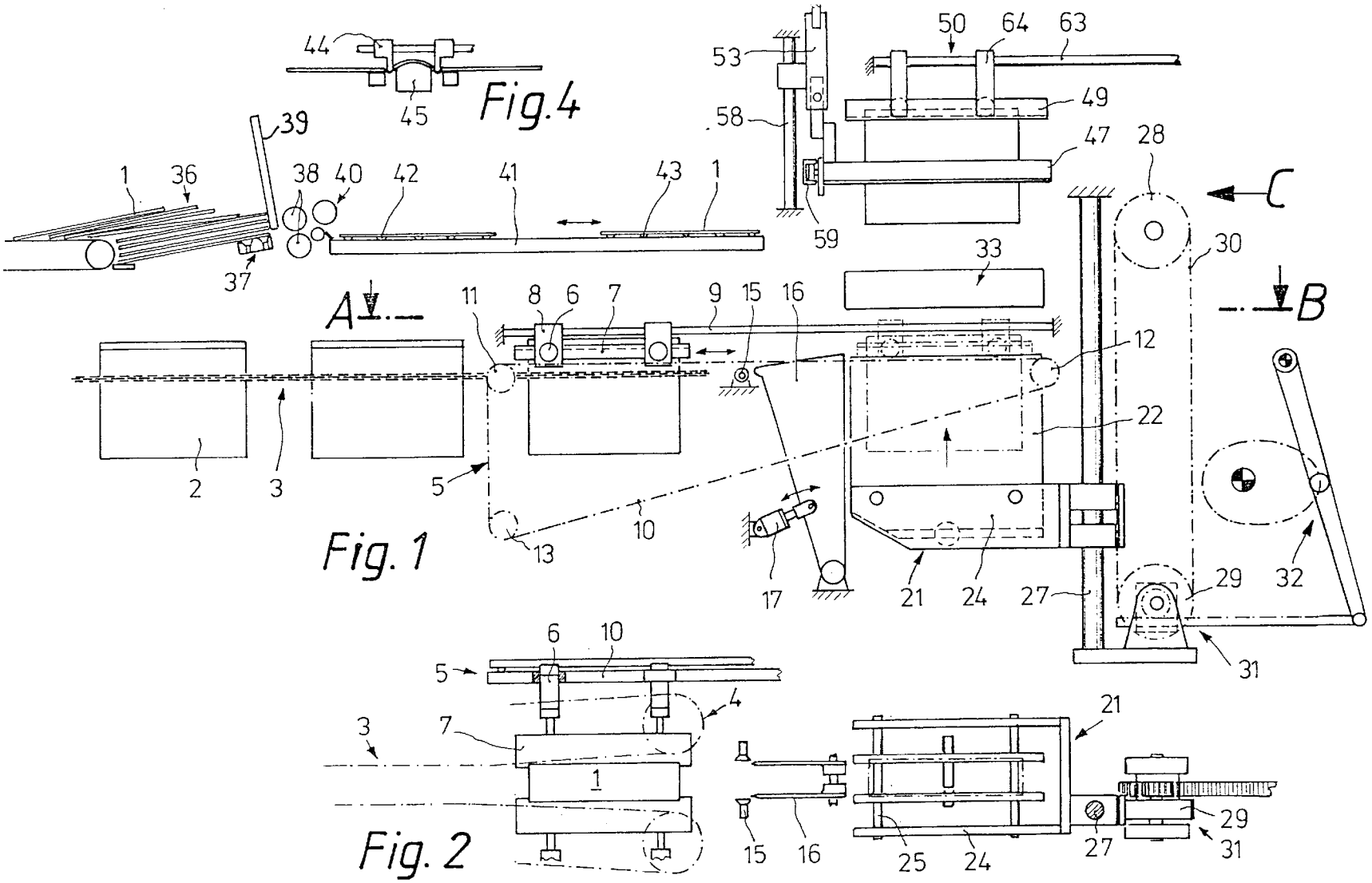
FIG. 1, an insetting machine in side view.
FIG. 2, the insetting machine in a plan view according to the cutting line A-B in FIG. 1.
FIG. 4, the book case groove- and spine-forming device in an individual representation.
Figure 3:
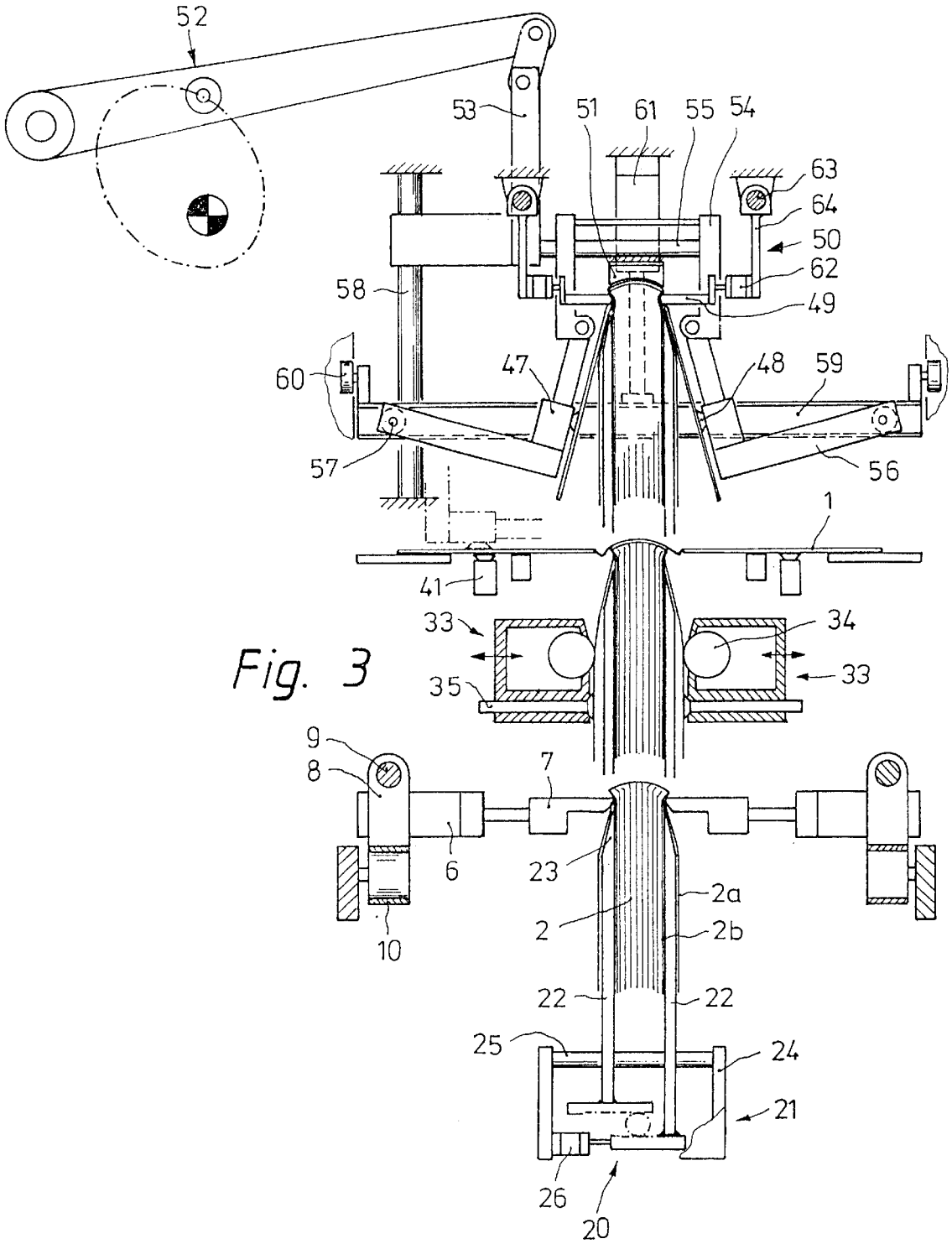
FIG. 3, the insetting machine in a sequence of motion in a view according to the arrow direction C in FIG. 1 in section.

Referring now to FIGS. 1–4, rounded and pressed inner books 2 which are to be cased into book cases 1 are conveyed with their spine directed upwards by a cleated chain conveyor 3, which holds the inner books 2 in a clamped manner and has a clocked opening device 4, into a feeding conveyor 5 of the insetting machine which grasps the inner books 2 in the groove region by means of co-operating rails 7. The rails are controllable by means of pneumatic cylinders 6 that move the rails 7 between closed and opened positions, on slides 8 and brings them with a constant stroke cyclically, aligned with mid-inner book height, into a receiving point of the insetting machine. By means of pneumatic closing, the rails 7 of the feeding conveyor 5 automatically adjust to the inner book 2 thickness. The slides 8 with the rails 7 of the feeding conveyor 5 are displaceable along guide rods 9 and driven by toothed belts 10, which rotate around deflection wheels 11, 12 and 13 and by a non-illustrated drive that executes a forward and return stroke. To accelerate the setting of the adhesive during casing, the rails 7 may be heated to warm up the inner books 2.

The inner books 2, as they are fed into the receiving point of the insetting machine, pass suckers 15, which are pneumatically controlled so as to be capable of swivelling towards and away from the inner books and by means of which the outer end papers 2*a* of the inner books 2 are grasped, spread apart from the inner end papers 2*b* and conveyed along guiding plates 16 for complete separation of the end papers 2*a* during further transport, wherein the guiding plates 16 swivel under the control of a pneumatic cylinder 17 between the spread-apart outer and inner end papers 2*a* and 2*b*. This swivelling motion of the pneumatic cylinder is indicated schematically by the directional arrows shown just above the pneumatic cylinder 17 in FIG. 1 and the swivelling is about a pivot disposed at the lower extremity (as shown in FIG. 1) of the guide plate 16. The spacing of the suckers 15 and guiding plates 16 is adjustable in accordance with the specific inner book thickness.

In the receiving point of the insetting machine the inner books 2, which have the outer end papers 2*a* held in a position spread apart from the inner end papers 2*b* by the guiding plates 16, are grasped below the groove edge by a gripper 21 comprising clamping plates 22, which act laterally upon the inner book 2 and have an upwardly directed chamfer 23, and are conveyed into an upper joining point. The gripper 21 comprises a U-shaped carrying part 24, in which the clamping plates 22 are guided by means of carrying rods 25 in the sense of a variation of the spacing for receiving and releasing the inner books 2, controlled by pneumatic cylinder 26, in a constrained coupling via a rack-and-pinion gear 20 and centrically aligned with the inner book thickness. By means of pneumatic closing, the clamping plates 22 automatically adjust to inner book thickness. The U-shaped carrying part 24 with the two clamping plates 22 is situated displaceably on a vertical guide column 27 and displaced by a toothed belt 30, which is guided around deflection wheels 28 and 29, in a vertical plane of motion along the guide column 27 in synchronism with the feeding conveyor 5, starting from the pre-set groove edge of the inner book with a constant stroke between a bottom and top reversing position. The driving of the toothed belt 30 is effected via a rack-and-pinion gear 31 operated by a cam drive 32.

As they move upwards, the inner books 2 pass adhesive application devices 33, which are disposed laterally of the path of motion of the gripper 21 and are pneumatically steerable out of and back into the path of motion of the gripper 21 and have rollers 34 for applying an adhesive layer onto the surface of the outer end papers 2*a* of the inner book 2. The adhesive application devices 33 have suction apertures 35, which may be cyclically acted upon by suction air and suck the outer end papers 2*a* in order to lift them off the gripper 21 and, as a result of their being pulled taut by the conveying motion, apply them against the rollers 34 to implement a so-called flying glue application.

From a magazine 36, book case 1 are intermittently removed individually from the underside of a stack in that the book case 1 is grasped in its front region by a suction element 37 and conveyed in the direction of the book case plane into the effective range of a pair of rotateably driven draw-in rollers 38 through a front edge stop 39. Disposed immediately downstream of the pair of draw-in rollers 38 is a bending-out apparatus for the book case 1 in the form of a rotating roller system 40. A book case conveyor 41 reciprocable by non-illustrated driving means and having double sucker arrangements 42 and 43 for receiving and further conveying two book case 1 simultaneously takes over the book case 1 from the draw-in roller pair 38 and/or from the roller system 40, wherein the sucker arrangements 42 and 43 grip and support the covers of the book case 1 from below before depositing them first in a station, in which the groove as well as the spine of the book case 1 are formed by means of groove-forming rails 44 and forming web 45. The book case 1 after being taken over by the—in conveying direction—downstream sucker arrangement 43 of the bookcase conveyor 41 are cyclically fed, aligned with mid-book case height, to a receiving point in the plane of motion of the inner book 2 and held in position.

Fold-to wings 47 with suction elements 48 take over the covers of the flat-lying book case 1, which is held in position by the book case conveyor 41, from the receiving point in order to transfer it, synchronously with the travel of the gripper 21 into the top end position, in a lifting/swivelling motion by its spine into the upper joining point, in which the spine of the book case 1 is supported against a shaped piece 51 made of an elastic material. The fold-to wings 47 hold the covers in a spread-apart position for casing an inner book 2, which is conveyed upwards by the gripper 21, and move them in a closing motion initially up against the outer end papers 2*a* resting against the clamping plates 22 of the gripper 21 and finally, after take-over of the book by shaped rails 49 of a discharge conveyor 50 and release of the inner book by the downward moving gripper 21, up against the inner book 2. During the return stroke of the gripper 21 the outer end papers are held by the fold-in wings 47, which have been steered inwards by the pneumatic cylinder 61, permanently in contact with the inner surface of the covers, which effects an application against the inner surfaces of the covers.

The drive for the lifting/swivelling motion of the fold-to wings 47 is effected by means of a common cam drive 52 having a connecting rod 53, which is slideably supported on a vertical guide rod 58, generates an up-and-down motion and acts upon the fold-to wing 47 at a transverse rod 55, which receives the fold-to wings 47 via a coupler 54. At the other end, the fold-to wing 47 is situated with an extension arm 56 and rollers 57 in a horizontal connecting link 59, which in turn is guided by rollers 60 against a machine wall, wherein the connecting link 59 under the control of a pneumatic cylinder 61 executes a superimposed up-and-down motion.

The books, which are lifted into the top end position by the inner book gripper 21 and supported by their spine against the shaped piece 51, are grasped by the shaped rails 49 of the discharge conveyor 50, which engage into the groove regions and are steerable by pneumatic cylinders 62 into a closing and opening position and adjust automatically to book thickness, after which the inner book gripper 21 and the fold-to wings 47 return to their starting positions for receiving the next inner book 2 and the next book case 1 respectively. The shaped rails 49 of the discharge conveyor 50 are situated on a slide 64, which is displaceable in a horizontal plane of motion along guide rods 63 and which by means of a non-illustrated toothed belt mechanism executes a constant forward and return stroke oriented to mid-book height. The books are finally conveyed by the discharge conveyor 50 into a known book delivery.

What is claimed is:

1. A machine for casing inner books into book cases by gluing outer end papers of an inner book to inner surfaces of covers of a book case, having a conveyor, which at cyclical intervals feeds successive inner books with a spine directed upwards in a vertical plane of motion to a cyclically fed book case, which is held in position in the plane of motion of the inner book, and having means for moving the covers up against the inner book and joining an end papers and book covers, wherein the improvement comprises a feeding conveyor, which feeds the inner book with the spine directed upwards to a lower receiving point and has a device for spreading apart the outer end papers of the inner book, and a gripper, which grasps the inner book between the spread-apart outer end papers and conveys it from the lower receiving point to an upper joining point.

2. A machine according to claim 1, wherein the gripper is displaceable by driving means with a constant stroke between the lower receiving point and the upper joining point.

3. A machine according to claim 2, comprising adhesive application devices, which are disposed laterally of the plane of motion of the gripper and steerable out of the path of motion of the gripper and back and have rollers for applying an adhesive layer onto the end papers of the inner book during the upward motion, and means for lifting the end papers off the gripper and moving them up against the rollers.

4. A machine according to claim 3, wherein the means for lifting the end papers are suction apertures, which are disposed in the adhesive application devices and may be acted upon by suction air.

5. A machine according to claim 4, comprising means for holding, which take over the covers of the flat-lying book case from a receiving point in the plane of motion of the inner book, may be acted upon by air and are cyclically controlled by driving means in a lifting/swivelling motion in such a way that the book case is transferred by its spine into the upper joining point and the covers are held in a spread-apart position and execute a closing motion after feeding of an inner book.

6. A machine according to claim 5, wherein the means for holding is controlled in such a way that the covers of the book case are held in contact with the gripper for applying the outer end papers against the inner surfaces of the covers during a return stroke of the gripper.

7. A machine according to claim 6, characterised by shaped rails of a discharge conveyor, which grasp the inner book cased into a book case in the upper joining point in a groove region and take it over from the gripper.

8. A machine according to claim 6, characterised in that the means for holding is formed by fold-to wings with suckers for holding the covers of the book case and the covers are held, under control of a work cylinder, in contact with the gripper for applying the outer end papers against the inner surfaces of the covers.

9. A machine according to claim 8, characterised by a shaped piece, preferably made of an elastic material, which holds the spine of the book case in position in the upper joining point.

10. A machine according to claim 9, characterised by a book case conveyor with sucker arrangements for transferring a flat-lying book case into the receiving point and for holding the covers for take-over by the means for holding.

11. A machine according to claim 10, characterised by suction elements, which are disposed in the region of the feeding conveyor and by means for which the outer end papers are grasped and spread apart from the inner end papers, and by guiding plates capable of swivelling between the spread-apart outer and inner end papers.

12. A machine according to claim 11, characterised in that the feeding conveyor comprises rails of a conveyor system, which grasp the inner book in a groove region, are movable relative to one another by means for pneumatic cylinders for receiving and releasing the inner book and feed the inner book cyclically, aligned with a middle portion of the inner book height, to the gripper in the receiving point.

13. A machine according to claim 12, characterised in that the rails are heated.

14. A machine according to claim 13, characterised in that the gripper comprises clamping plates of a carrying part, which for gripping the inner book below groove edges are aligned with mid-inner book thickness and in a constrained. coupling via a work cylinder and driving means are movable relative to one another during an opening and closing operation.

15. A machine according to claim 14, characterised in that the clamping plates have an upwardly directed chamfer.

16. A machine according to claim 15, characterised in that the carrying part with the gripper is displaceable by driving means along a guide between a bottom position and top reversing position.

17. A machine according to claim 16, characterised in that the rails of the feeding conveyor, clamping plates of the gripper and the shaped rails of a discharge conveyor are automatically adjustable to mid-inner book thickness.

18. A machine according to claim 1, characterised by shaped rails of a discharge conveyor, which grasp the inner book cased into a book case in the upper joining point in the groove region and take it over from the gripper.

19. A machine according to claim 2, characterised by shaped rails of a discharge conveyor, which grasp the inner book cased into a book case in the upper joining point in the groove region and take it over from the gripper.

20. A machine according to claim 3, characterised by shaped rails of a discharge conveyor, which grasp the inner book cased into a book case in the upper joining point in the groove region and take it over from the gripper.

* * * * *